US005863043A

United States Patent [19]

Bitner

[11] Patent Number: 5,863,043

[45] Date of Patent: Jan. 26, 1999

[54] DECK OF PLAYING CARDS FOR PLAYING ALPHABET LEARNING GAMES AND SPELLING GAMES

[76] Inventor: Gary Bitner, 14317 139th Ave., Ct. W., Taylor Ridge, Ill. 61284

[21] Appl. No.: 394,188

[22] Filed: Feb. 24, 1995

[51] Int. Cl.[6] ..... A63F 1/00

[52] U.S. Cl. ..... 273/299; 273/302; 273/304; 273/306; 273/308; 434/172; 434/167

[58] Field of Search ..... 273/299, 272, 273/302, 304; 434/172, 171, 159, 167

[56] References Cited

U.S. PATENT DOCUMENTS

| | | | |
|---|---|---|---|
| D. 56,985 | 1/1921 | Moore | 273/299 |
| 1,557,824 | 10/1925 | Fritz | 273/299 |
| 2,766,987 | 10/1956 | Seelbrede et al. | 273/272 |
| 4,333,656 | 6/1982 | Sommer | 273/299 |
| 5,417,432 | 5/1995 | Dwyer | 273/299 |

OTHER PUBLICATIONS

Hoyle's Modern Encyclopedia Of Card Games by Walter B. Gibson, "Eights", Rummy, pp. 106 and 291–292, Doubleday & Company, Dec. 1974.

Games Magazine, "Uno", p. 38, Nov. 1983.

*Primary Examiner*—Benjamin H. Layno

*Attorney, Agent, or Firm*—Laff, Whitesel, Conte & Saret, Ltd.

[57] ABSTRACT

A deck of cards is adapted to enable all ages to play a game (of many games) which is of interest to them. Each of 104 cards in a deck of cards has an alphabetical letter and a numerical value along with a cartoon which begins with a phoneme that corresponds to the letter so that the cards may be used as flash cards to teach the alphabet to small children. Some games require only a matching to two alphabetical characters. Other games are designed to permit players with low scores to "gang-up" on players with high scores. Still other games fit between these extremes to challenge the players skills and to provide games of interest to various age groups.

1 Claim, 11 Drawing Sheets

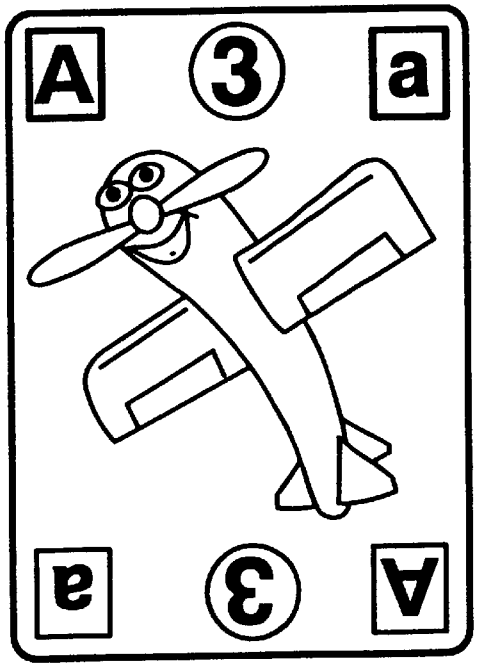
FIG. 2
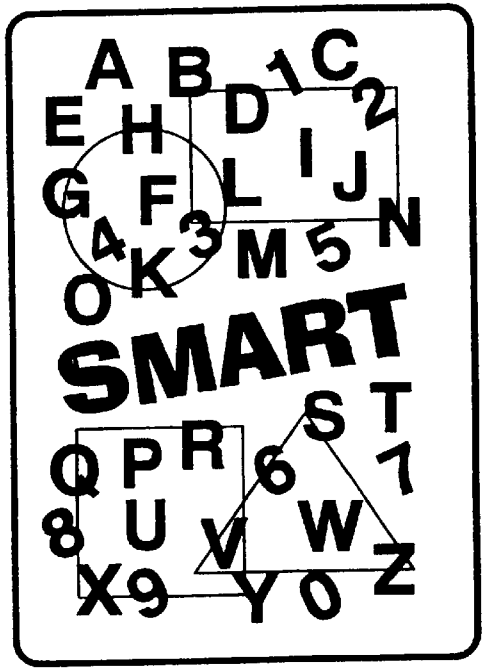
FIG. 3
FIG. 4

DECK OF PLAYING CARDS FOR PLAYING ALPHABET LEARNING GAMES AND SPELLING GAMES

This invention relates to educational and entertaining card games for all ages, with a great variety of players, and more particularly to a single card deck which may be used in many ways not only to play specific games, but also to encourage innovative players to invent their own games.

BACKGROUND OF THE INVENTION

There are card games which are similar to, but different from the invention, a few of which are shown and described in the following patents: Design U.S. Pat. Nos. 56,985; 118,977; and 169,557; and U.S. Pat. Nos. 627,046; 1,012,574; 1,076,307; 1,191,419; 1,320,899; 1,377,327; 1,401,001; 1,448,441; 1,485,146; 1,557,824; 1,705,883; 2,000,812; 2,042,930; 2,265,334; 4,333,656; 4,428,582; 4,775,157; 4,826,175; 4,923,199; 5,014,996; 5,092,777; 5,199,714; and 5,203,706.

These patents describe many different card designs and procedures for playing games; however, they are focused on some particular audience or style of playing. Hence, some games may be designed for small children. Other games may be designed for adults. Some games may be educational while other games are purely entertaining. In general, games involving a single deck of cards are not games which may be played by almost anyone from preschool to adults with a high level of interest for all persons. For the adult, the invention provides a wide range of games ranging from intellectual pursuits to the kind of almost trivial play which may be carried on while the main effort is socializing.

One disadvantage of card and similar games is that they appear to attract the public's interest for a while, and then disappear as the public's attention span wanes. Thus, there is a constant need for new games to replace those which have run their course. In order to increase its staying power and increase its life time, it is desirable for a deck of cards to have a great variety of different game uses so that play may be switched before boredom sets in. Also, the life time of and interest span for a deck of cards, or other game pieces, is greatly enhanced if creative people can invent and design their own games. Among other things, these features may be provided by cards having different values or symbols so that each game may be centered on a matching or scoring procedure which is convenient for such a game.

SUMMARY OF THE INVENTION

One advantage of the inventive game is that, if small children observe adults enjoying a game being played with the inventive deck of cards and if they find that they can enjoy a game also played with the same deck, there is a substantial inducement for the child to play such a game. Since the child's game is educational, there is a contribution to the child's learning curve. Thus, for the adult with an over riding interest in the child's learning, the use of the inventive cards with the enhanced attraction is of great importance.

Accordingly, an object of the invention is to provide a deck of game cards which has something for many different classes of people. In particular, an object is to provide a deck of cards having many different scoring and matching markers. Here an object is to provide a single deck which can function as flash cards for teaching very young children to read the alphabet or which can function as game pieces that can be used by adults to play a variety of games, many being sophisticated games. A further object is to provide a means for creating games which may be invented by the players themselves.

In keeping with an aspect of the invention, a deck of cards has a hundred and twenty-seven cards. Each of one hundred and four cards has a letter of the alphabet and a cartoon or cartoon-like picture which may appeal to very young children and still be cute for adult interests. Each of these cards also has an alphabetical letter in both upper and lower case for identifying the card and for teaching the alphabet when the deck is used as a flash card for children. The letter and cartoon are associated so that a young child seeing the cartoon character and pronouncing its name will likely use a correct pronunciation of the letter appearing on the card. A number also appears on the card to give its point value. To provide for variation in the games, the numbers may be printed in different colors or otherwise distinguished so that the point values may be tailored to the needs of particular games. The deck also includes special cards which introduce opportunity similar to the opportunities provided by chance cards which are drawn in various games, especially children's games, or to jokers and wild cards which are, perhaps, more appropriate for adult games.

BRIEF DESCRIPTION OF THE DRAWINGS

FIG. 2 shows a joker wild card.

FIG. 3 shows a chance card.

FIGS. 4 thru 30 show all twenty-six alphabetical cards in a suit.

DETAILED DESCRIPTION OF THE PREFERRED EMBODIMENT

Figure 1:
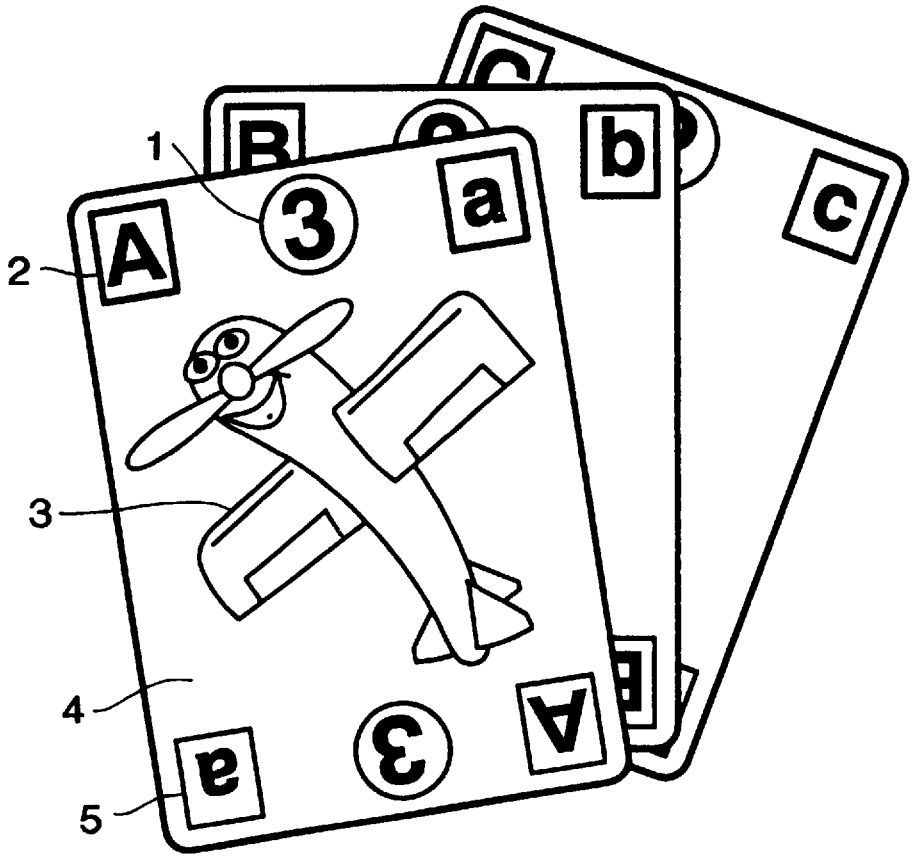
FIG. 1 shows three cards of the one hundred twenty-seven cards.
Figure 7:
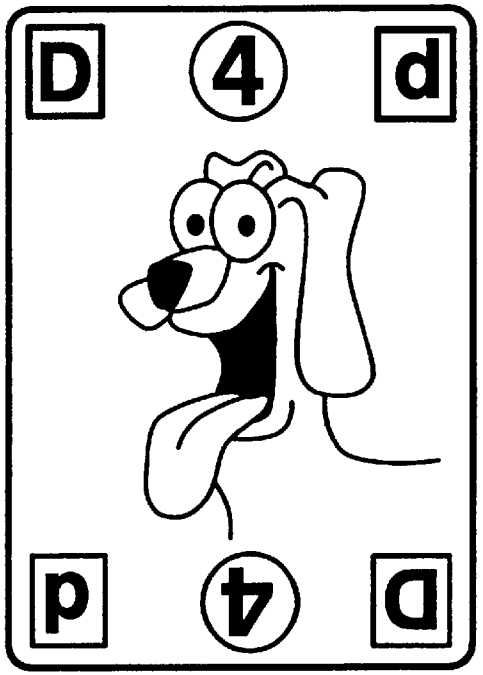
Figure 6:
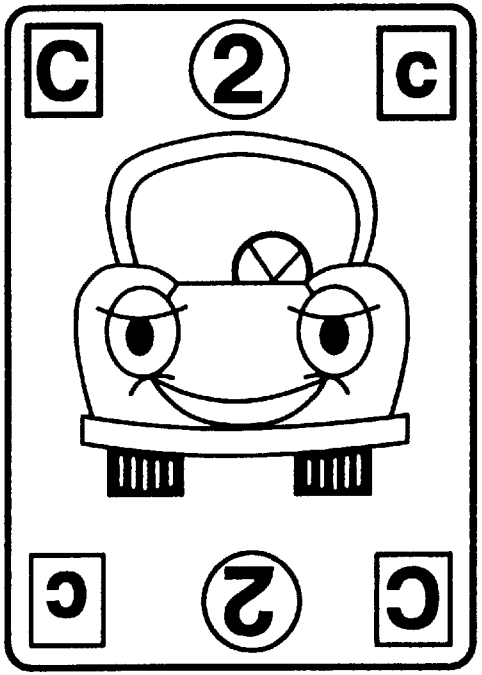
Figure 5:
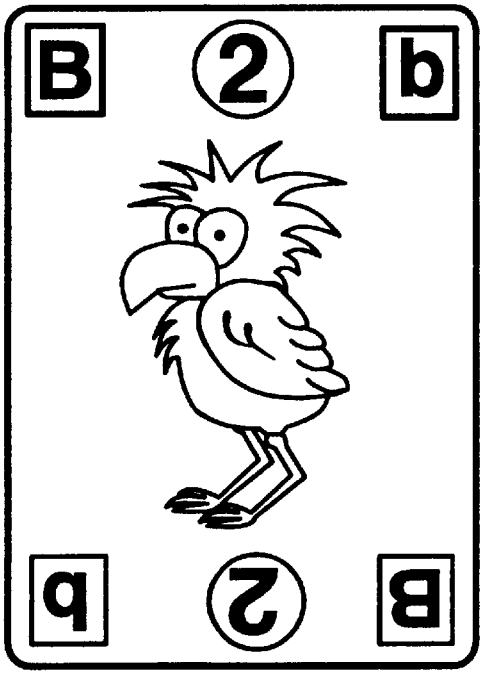
Figure 10:
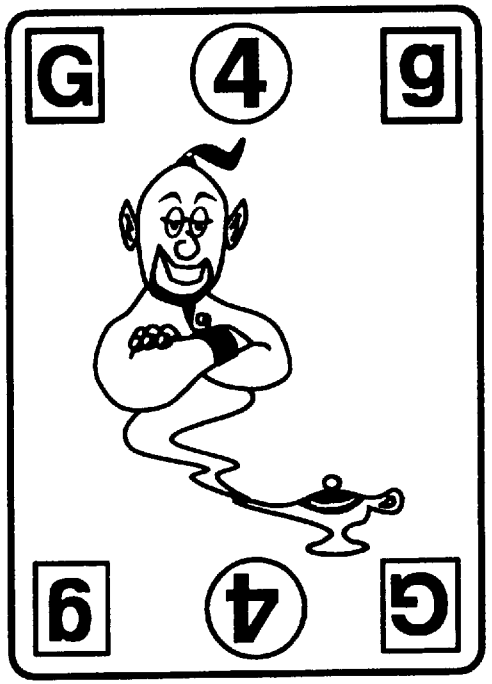
Figure 9:
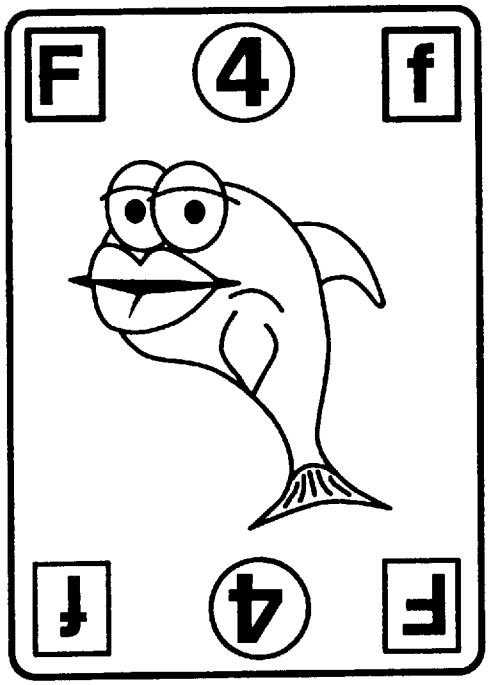
Figure 8:
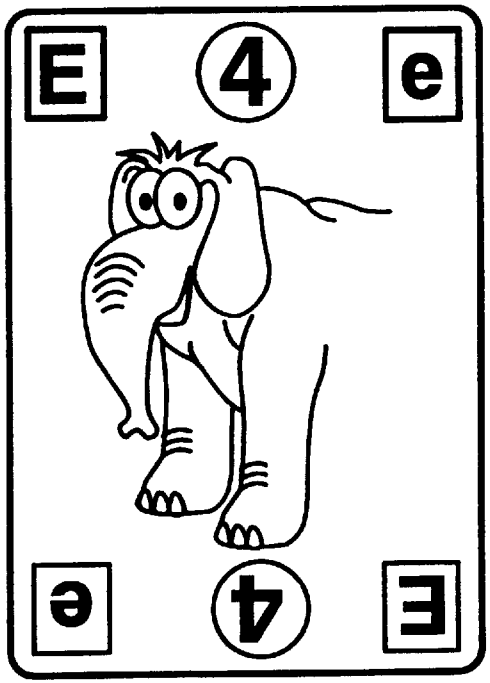
Figure 13:
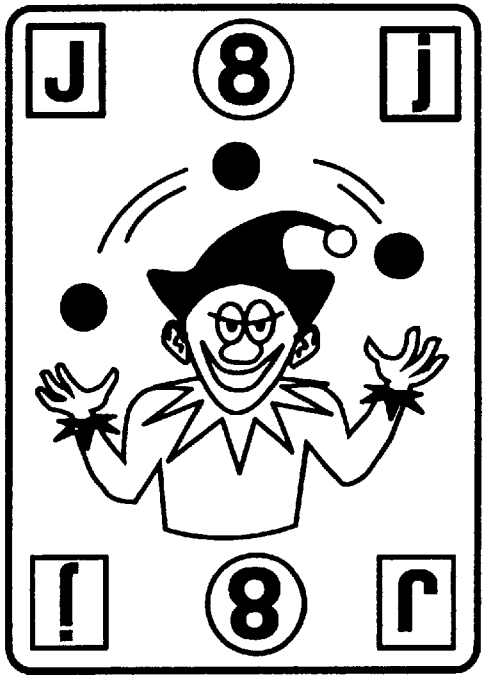
Figure 12:
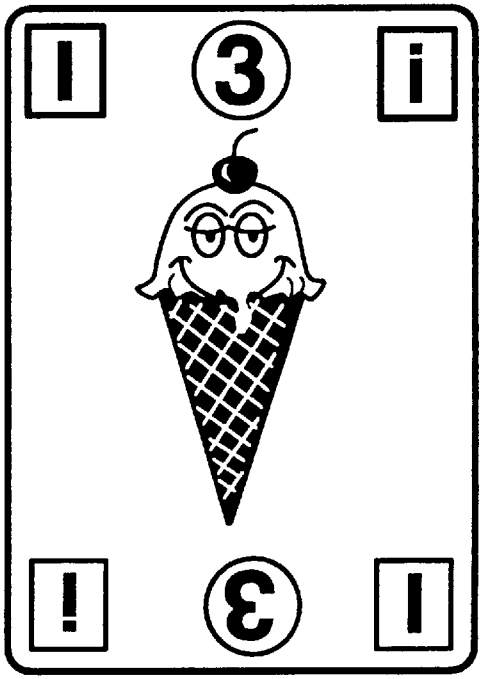
Figure 11:
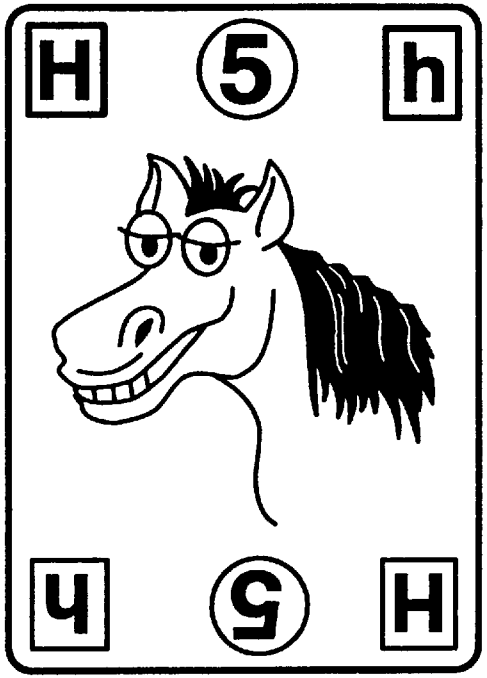
Figure 16:
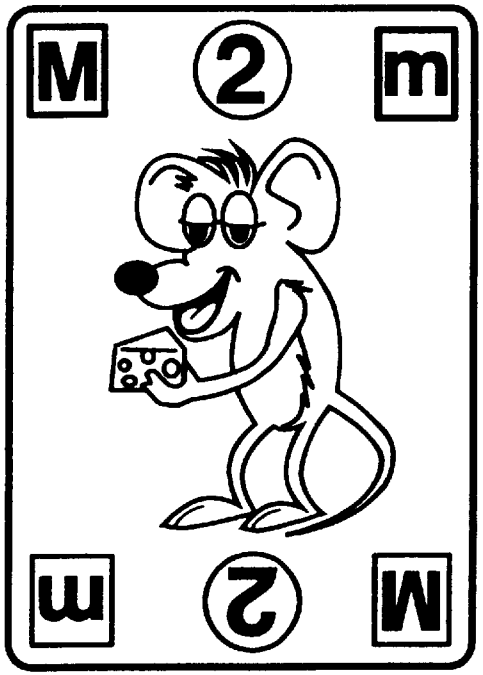
Figure 15:
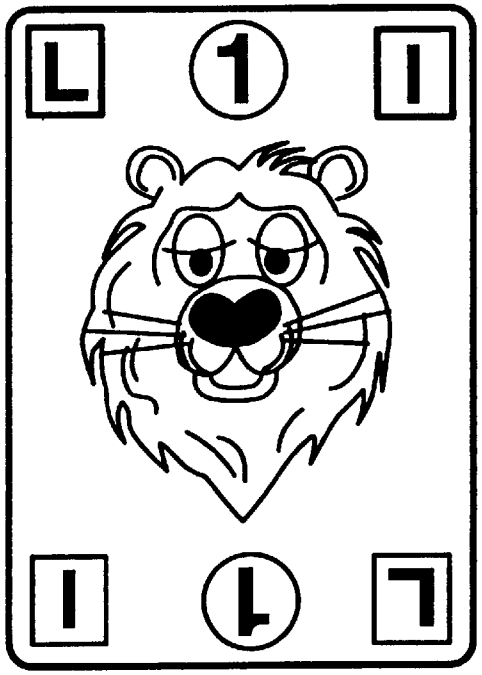
Figure 14:
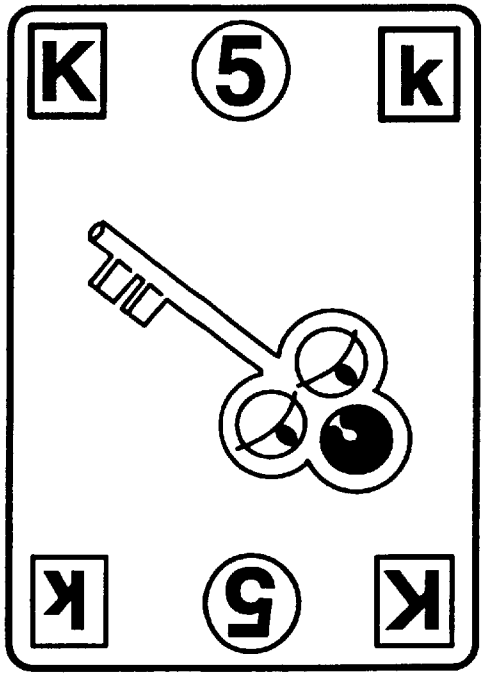
Figure 17:
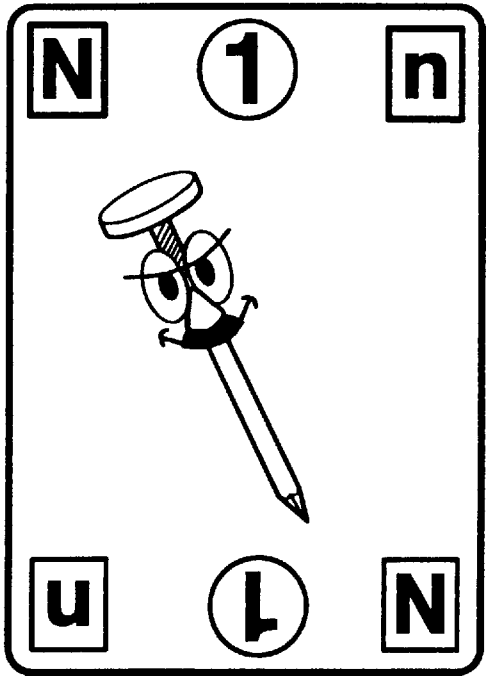
Figure 18:
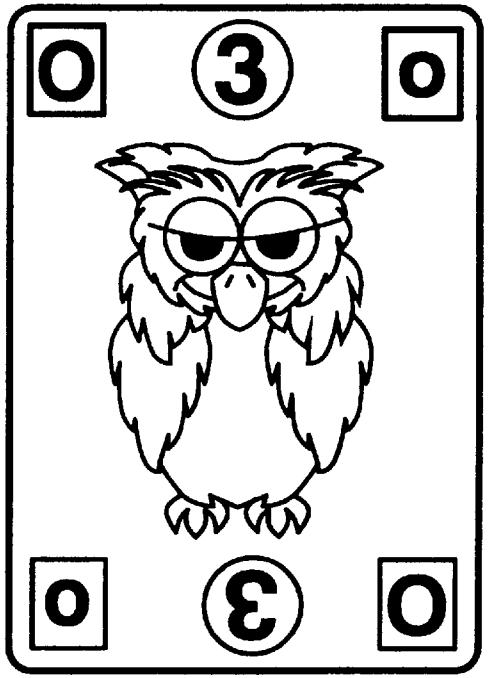
Figure 19:
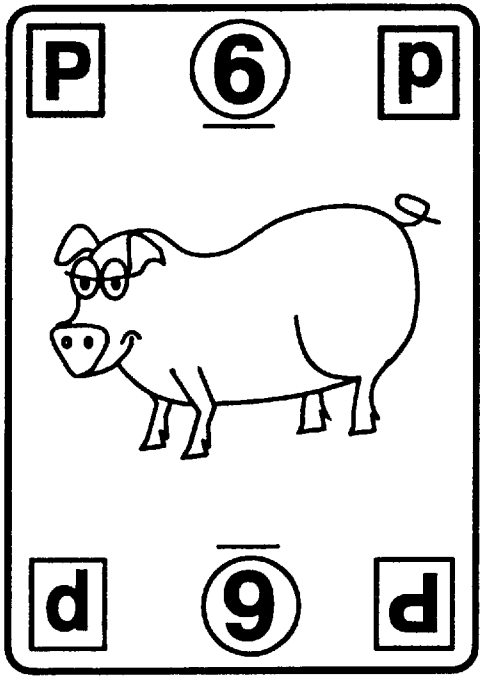
Figure 20:
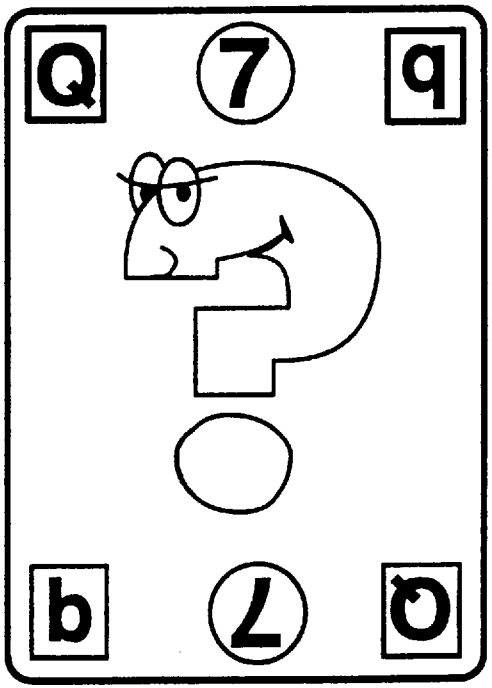
Figure 21:
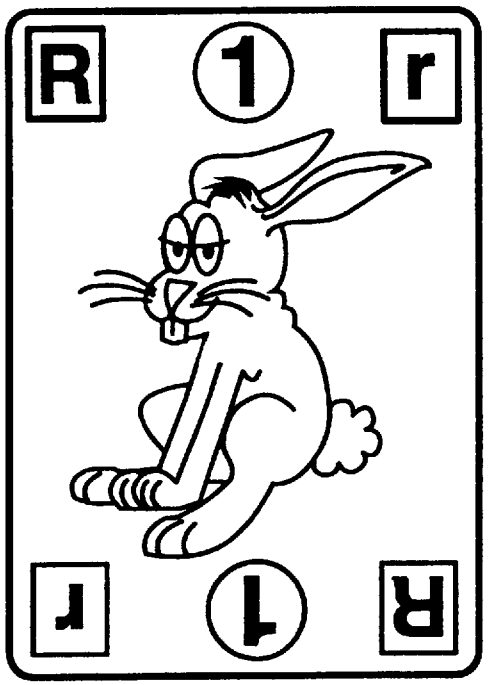
Figure 22:
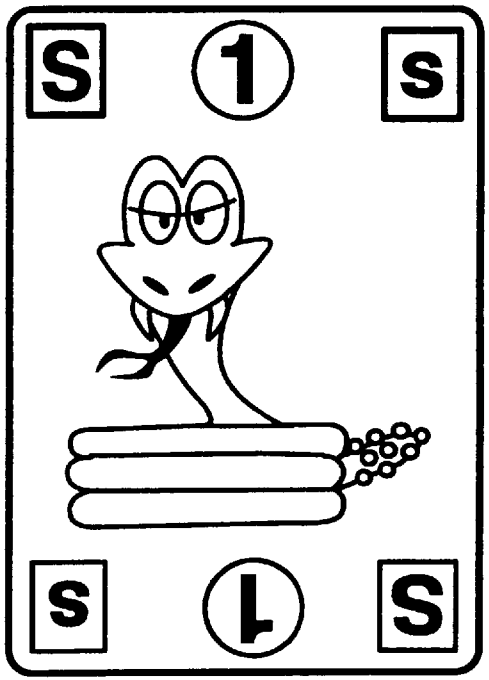
Figure 25:
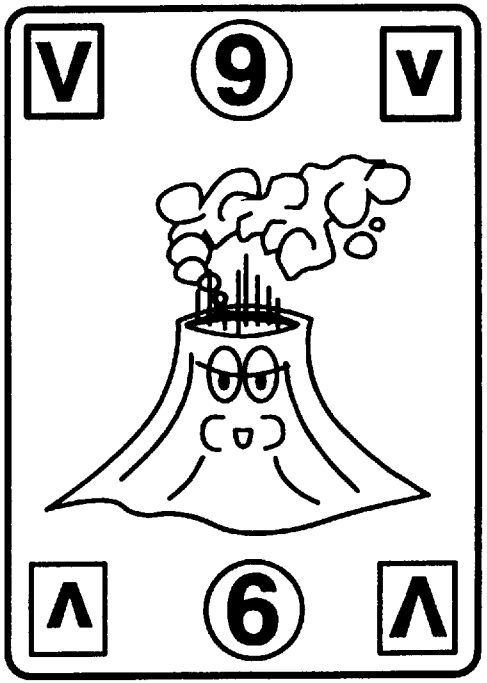
Figure 24:
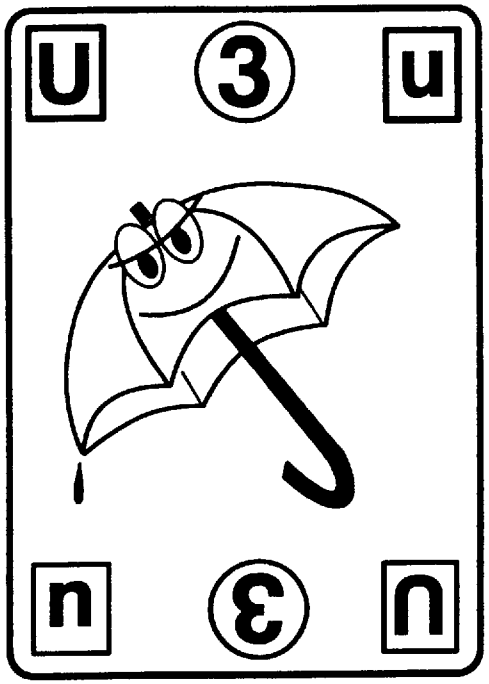
Figure 23:
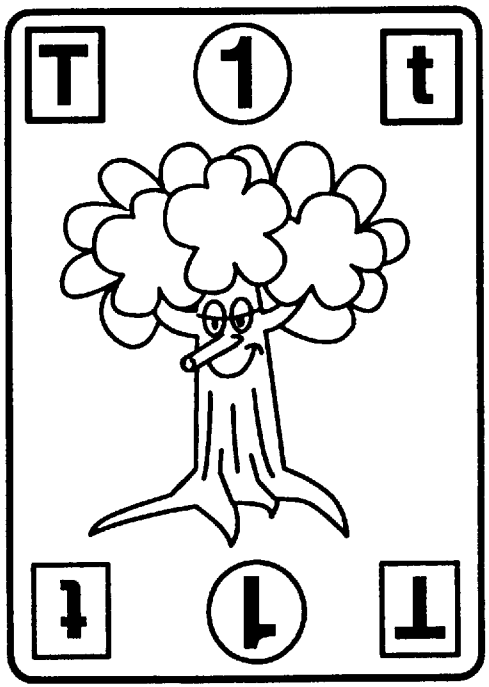
Figure 28:
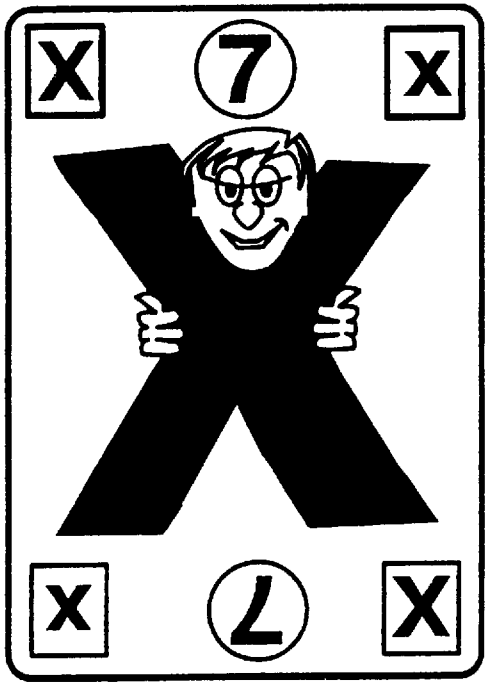
Figure 27:
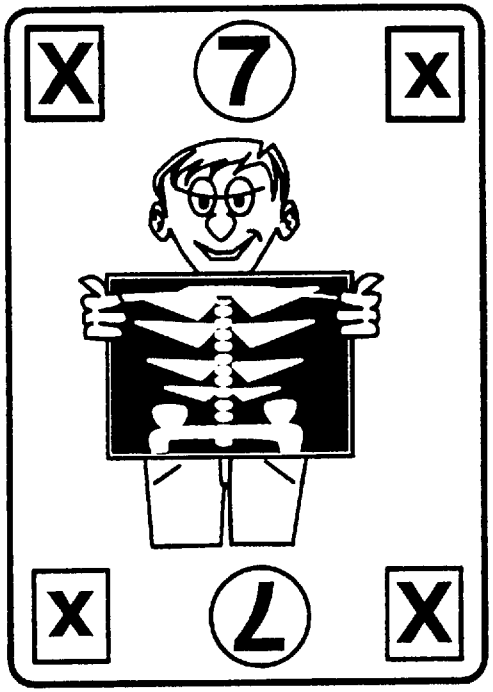
Figure 26:
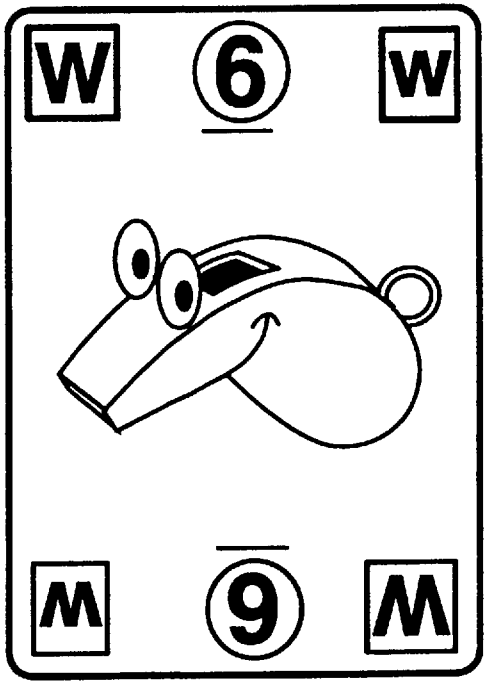
Figure 30:
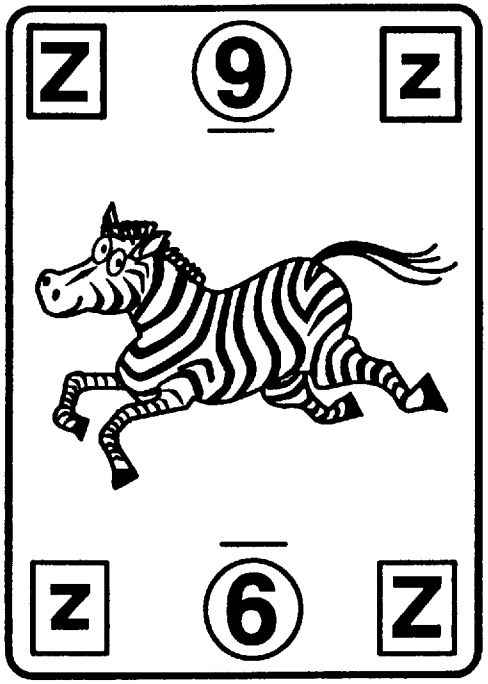
Figure 29:
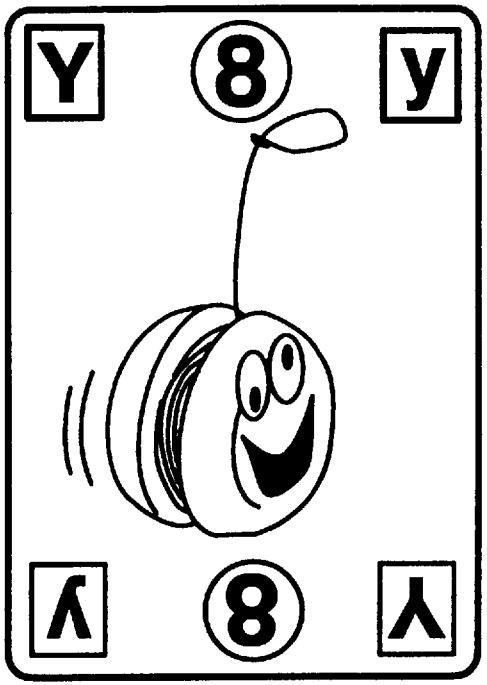

In greater detail, each card 4 has a number 1 which is a point score value for the individual card. These points are awarded on a playing (or declaring in a meld) of the card carrying the number. Some of these numbers, may also be distinctively displayed, such as by being printed in red ink or enclosed in a square frame to give bonus or penalty points in some games. Both a capital and a lower case letter 2 and 5, respectively, have a phoneme which is the same as the initial sound of the name of the cartoon character 3 also printed on the card. Thus, a very young child seeing the airplane will make a partial sound similar to the sound of the spoken letter "A" which also appears on the card. Since there are four suits, the same cartoon may appear on each of four cards. Or, so that the child will quicker realize that the sound of "A" applies to many different words and not to just the name of a single cartoon character, each "A" card, for example, may have a different picture for each of the suits. For example, the "A" cards in the individual one of the four suits might, respectively, have cartoons of an airplane, arm, apple, and ant.

The four suits are identified by colors (red, blue, green and yellow) so that the small child may easily identify the suit, as distinguished from having to recognize special symbols such as the familiar hearts, spades, diamonds and clubs. The jokers and wild cards are printed in a different color, such as black.

Each deck has the following cards:

| NUMBER OF CARDS | DESCRIPTION OF CARDS |
|---|---|
| 26 | Alphabetical letters A thru Z with a Crimson Red background. |
| 26 | Alphabetical letters A thru Z with a Sky Blue background |
| 26 | Alphabetical letters A thru Z with a Bright Green background. |

-continued

| NUMBER OF CARDS | DESCRIPTION OF CARDS |
|---|---|
| 26 | Alphabetical letters A thru Z with a Bright Yellow background. |
| 4 | Extra letter "B" (two letters "B" appear on a card) appears on one card of each color background. (This double "B's" card means: "Back to You") |
| 4 | Extra card with letter "L" (two letters "L" appear on a card appears on each color background. (This card means: "Lose your Turn"). |
| 4 | Extra card with letter "D" (two letters "D" appear on a card appears on each color background. (This D card means: "Draw a Card"). |
| 11 | Joker Wild Cards |

When the alphabetical identification value is critical, the cards with extra letters are played as if they were a single letter cards. That is, for example, to spell a word, the "B" and the "BB" cards are the same.

The alpha-numerical relationship values assigned to and printed on each of the cards are, as follows:

| | | | | |
|---|---|---|---|---|
| A = 3 | G = 4 | M = 2 | S = 1 | Y = 8 |
| B = 2 | H = 5 | N = 1 | T = 1 | Z = 9 |
| C = 2 | I = 3 | O = 3 | U = 3 | |
| D = 4 | J = 8 | P = 6 | V = 9 | |
| E = 4 | K = 5 | Q = 7 | W = 6 | |
| F = 4 | L = 1 | R = 1 | X = 7 | |

The remaining cards may or may not be assigned numerical values for each of the games that may be played with the deck.

One characteristic of the inventive deck of cards is that at least five different games may be played with it and further the deck lends itself to creative impulses to invent new games. This invitation to invent-your-own-game is important to all, but especially important for children who have a natural impulse to be creative.

All games played with the inventive deck involve the usual shuffling, playing in turn usually with the player on the left taking the next turn. Other conventions, such as determining who takes the first turn, can be adapted to accommodate such things as the age of the player; or, the first player may be selected by drawing a high or a low card. Most of the games may be played by two to six players; however, the size of the deck gives considerable room for innovatively accommodating different numbers of players.

Spelling Game

This is a spelling game, played with the object of accumulating the highest point score. The game ends when either all cards have been played or when no player can make a new word, which ever occurs first. In this spelling game, the jokers, with a point score of ten points, may be used as a substitute for any letter of the alphabet.

The game begins with each player being dealt a hand of eleven cards. A wild card is placed face up in the center of a playing surface, usually a table top. The remaining cards are placed face down in a draw pile on the playing surface. The first player forms a word by using cards from his hand, the face up wild card being used as any one of the letters in the formed word. The cards selected from the player's hand are then laid side by side on the playing surface, in either a horizontal row or a vertical column. The point scores on these cards are totaled and entered on a score card. Then, the player draws a number of cards from the draw pile in order to replace the cards that were selected and laid down on the playing surface in order to form the word.

The next player on the left forms a new word from the cards in his hand by using an exposed letter in the first word as one of the letters in his new words.

The play continues with each player taking a turn as play moves around the table in a clockwise rotation. Any player who can not form a new word misses his turn. Play ends when either no player can form a new word or when the pile is exhausted.

Flash

This game is primarily directed to smaller children who are in the process of learning the alphabet.

One person is designated as the "director", who will flash the cards, one card at a time until the entire deck of cards is exhausted. The object is to see who can score the most points (a sum total of the numbers on the cards) before the deck is exhausted and all cards have been flashed.

The playing procedure is for the director to flash each card, in turn. The first child to recognize the card claps his hands and says the letter. Then, the points on the flash cards are entered on the score card. To increase the interest for older children, and perhaps adults as well, the cards are flashed faster and faster. The penalty for clapping ones hands and then failing to say the correct letter is a deduction of the cards points from the players then existing score.

A variation is to begin with a score, such as "100" and to deduct the point score from the then existing score. The first player to reach zero wins.

Jokers Wild

The object of this game is to be the first player to reach a designated score, 800-points (or more) being the suggested score for ending the game. The player who discards the last card leading into the designated score gets a bonus of fifteen extra points, for example.

The game is started by dealing seven cards to each player and placing the remainder of the cards on a draw pile in the center. One card is turned over (face up) to start a discard pile.

The game is played by drawing one card before a play and then discarding one card after a play. The play is to lay three or more cards (a) of the same color and in an alphabetical sequence, or (b) of the same alphabetical character. A joker may be played as a substitute for any one of the alphabetical cards. The scoring is the sum total of the points on the cards which are laid down with jokers counting as five points.

If one player can add to a sequence of cards laid down by another player, a bonus of five extra points are added to the point value printed on each card that is so discarded.

If the pile is exhausted before the player's hands are exhausted, the discard pile is reshuffled and placed face down to replenish the draw pile.

Finders Keepers

The object of this game is to match pairs of alphabetical letters. The score is made by entering on a score sheet the number on one of the pair of cards. Alternatively, each matched pair of cards can count as a single point so that every pair has a value equal to every other pair.

To play "finders keepers", all jokers and wild cards are removed from the deck, leaving only the alphabetically designated cards. The cards are laid out, face down, in a plurality of rows and columns. Any two cards are selected and turned over. If they match, the player removes and keeps the matching cards and then turns over two more cards. If the selected cards do not match, they are placed face down and play moves to the next player.

The game ends when the last of the face down cards has been removed from the rows and columns. The winner is the player who has collected the most cards.

Zap

The object of this game is to accumulate a designated score (such as 800-points) or to be the person who places their last card on the discard pile.

The game is played by dealing seven cards to each player. The remainder of the cards are placed face down in a draw pile, with one card turned up to form a discard pile. If a joker appears as the turned up card, a designated player (usually in the rotational position of the first or next player) will declare it to be a certain color so that play can begin. Each player discards a card, in turn, the allowed discard being either an alphabetical or a color match of the last card which is showing on the discard pile. A wild card can be used as any letter or any color. If the player is unable to discard, he draws a card from the pile.

If the extra "B" cards is played on the discard pile, the direction of play rotation reverses (e.g. an existing clockwise rotation of play changes to a counter clockwise rotation of play or visa versa). If the "L" card is played, the next player in the rotation loses his turn. A joker is somewhat like a wild card which may be played as a card of any color or letter; however, it causes the next player in rotation to draw three cards from the pile and to lose his turn.

If for any reason a player can not discard, the play goes on to the next player.

When any player plays his last card, and says "zap", the game is over.

If the draw pile is exhausted, the last discarded card remains as the start of the next discard pile. The remainder of the discard pile is then reshuffled and placed face down as a new draw pile.

Those who are skilled in the art will readily perceive how to modify the invention. Therefore, the appended claims are to be construed to cover all equivalent structures which fall within the true scope and spirit of the invention.

The invention claimed is:

1. A deck of playing cards consisting of one-hundred twenty-seven cards, said deck divided into three groups of cards comprising:

a first group of cards having one hundred four alphabetical cards divided into four suits, each suit of alphabetical cards having a different color designation thereon clearly distinguishing each suit of alphabetical cards, each suit of alphabetical cards representing all twenty-six letters of the alphabet wherein each suit of alphabetical cards having twenty-six alphabetical cards and each alphabetical card having a different letter designation thereon, each of said alphabetical cards also having an assigned numerical designation thereon, each of said alphabetical cards also having a picture of an object designated thereon, wherein the spelling of a word describing the picture of an object designated on any one of said alphabetical cards begins with a letter corresponding to the letter designation on said alphabetical card;

a second group of cards having twelve chance cards divided into three suits of chance cards, wherein each suit of chance card having four chance cards, each suit of chance cards having a different alphabetical letter designation thereon clearly distinguishing each suit of chance cards, said letter designation on said chance cards being distinguishable from said letter designations on said alphabetical cards, clearly distinguishing said chance cards from said alphabetical cards; and a third group of cards having eleven joker wild cards, all of said joker wild cards having designations thereon, clearly distinguishing said joker wild cards from said chance cards and clearly distinguishing said joker wild cards from said alphabetical cards.

* * * * *